United States Patent [19]

Gandrud

[11] Patent Number: 4,504,709

[45] Date of Patent: Mar. 12, 1985

[54] MEMBRANE SWITCH FOR HOPPER

[75] Inventor: Dale E. Gandrud, Owatonna, Minn.

[73] Assignee: Gandy Company, Owatonna, Minn.

[21] Appl. No.: 582,952

[22] Filed: Feb. 23, 1984

[51] Int. Cl.[3] ..... H01H 13/70

[52] U.S. Cl. ..... 200/52 R; 200/5 A; 200/61.2; 200/85 R; 200/159 B

[58] Field of Search ..... 200/5 A, 61.2, 61.21, 200/85 R, 86 R, 159 B, 292, 302.2, 295

[56] References Cited

U.S. PATENT DOCUMENTS

| | | | |
|---|---|---|---|
| 417,117 | 12/1889 | Thompson et al. | 340/617 |
| 848,519 | 3/1907 | Versteeg | 200/61.21 |
| 2,376,304 | 5/1945 | Anderson | 340/617 |
| 3,396,694 | 8/1968 | Gruber | 200/61.21 |
| 4,065,649 | 12/1977 | Carter et al. | 200/5 A |
| 4,066,851 | 1/1978 | White et al. | 200/5 A |
| 4,086,458 | 4/1978 | Dickey | 200/85 R |
| 4,143,253 | 3/1979 | Wagner et al. | 200/5 A |
| 4,320,573 | 3/1982 | Larson | 29/622 |
| 4,349,712 | 9/1982 | Michalski | 200/159 B |
| 4,365,408 | 12/1982 | Ditzig | 29/622 |
| 4,375,018 | 2/1983 | Petersen | 200/5 A |

*Primary Examiner*—J. R. Scott

*Attorney, Agent, or Firm*—Merchant, Gould, Smith, Edell, Welter & Schmidt

[57] ABSTRACT

An improved membrane switch (12) of greater sensitivity and simplified, lightweight construction which is particularly adapted for sensing material levels in hoppers, comprises a first non-conductive sheet (18) with conductive open contacts (22), leads (24), and contactor (28) provided on one side thereof. The first sheet (18) is folded back on itself and secured to a spacer or second sheet (20) such that the contacts (22) and contactor (28) are in aligned, normally spaced apart relationship. A second embodiment of the membrane switch (50) comprises four non-conductive sheets (52, 54, 70 and 74) stacked, instead of folded, and interconnected to form a thin yieldable envelope for the normally open contact (62) and contactor (76). In the second embodiment, the third sheet (70) acts as the spacer. In both embodiments, the spacer sheet extends along only one side of the contact and contactor, which are normally urged apart by the resiliency of the non-conductive material provided by the particular construction, but which yield to a closed position under relatively low, generalized pressure.

15 Claims, 7 Drawing Figures

Fig. 1
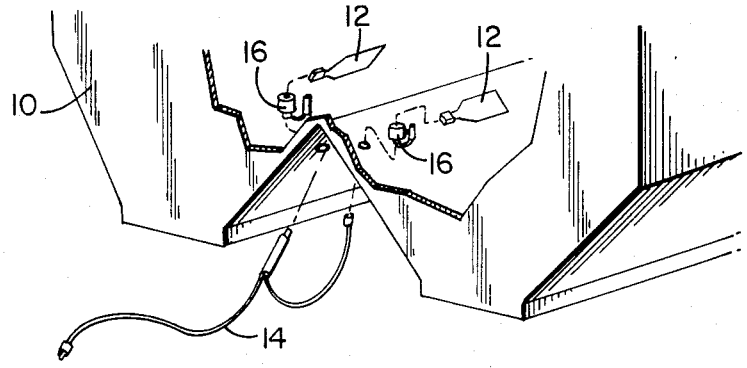
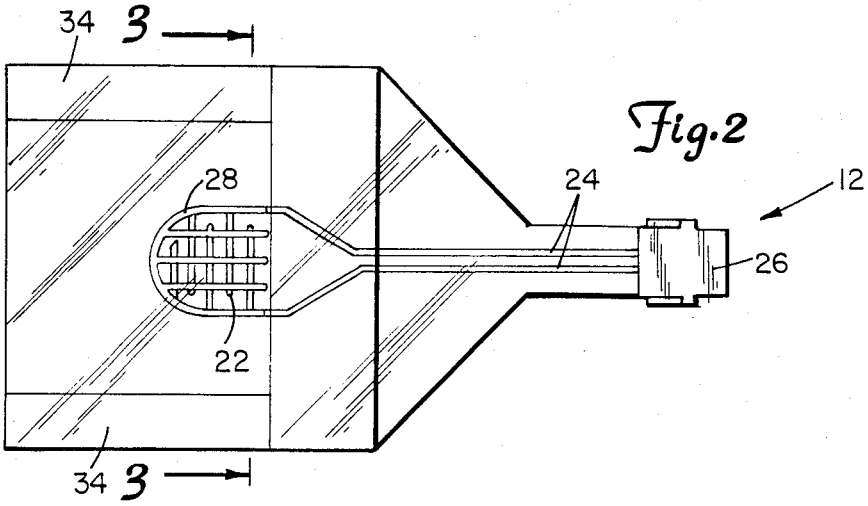
Fig. 2
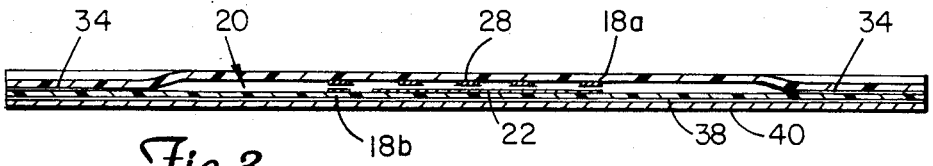
Fig. 3
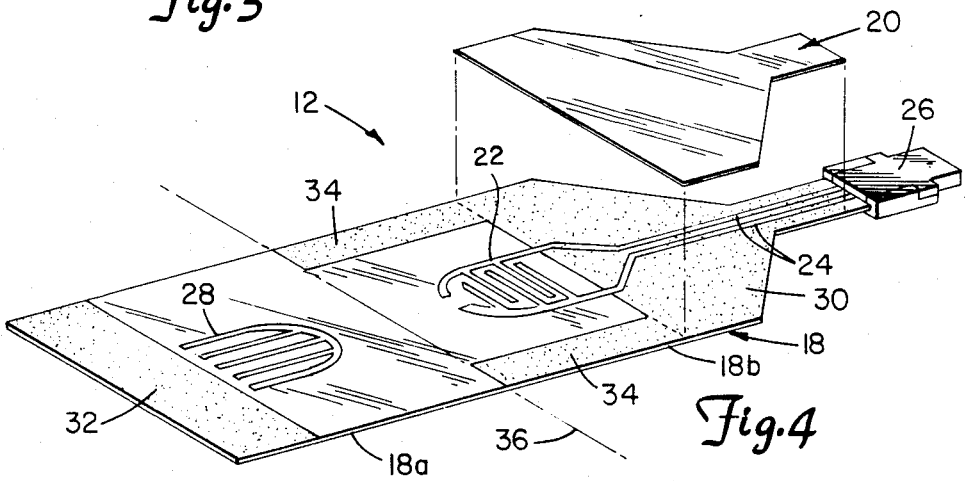
Fig. 4

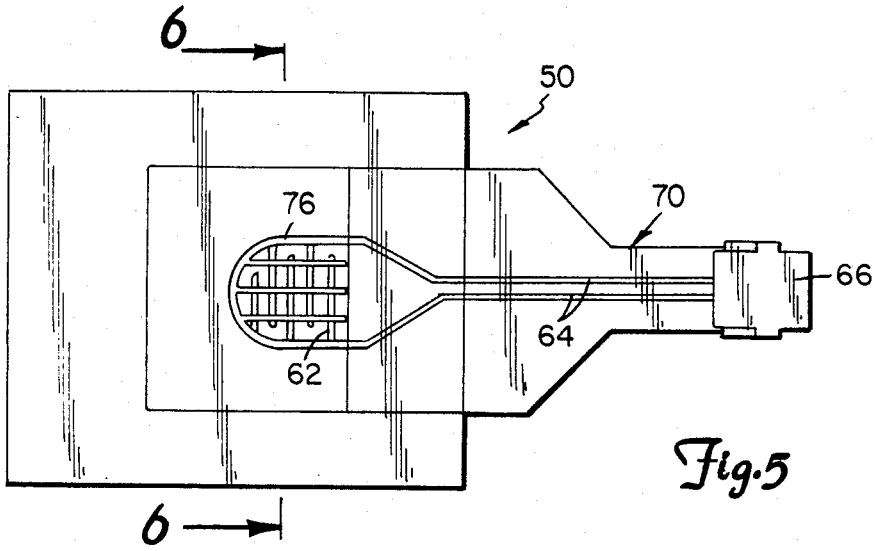
Fig.5
Fig.6
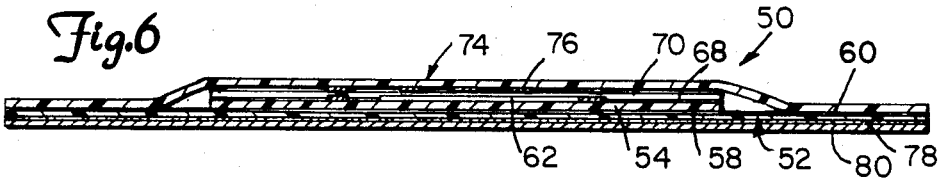
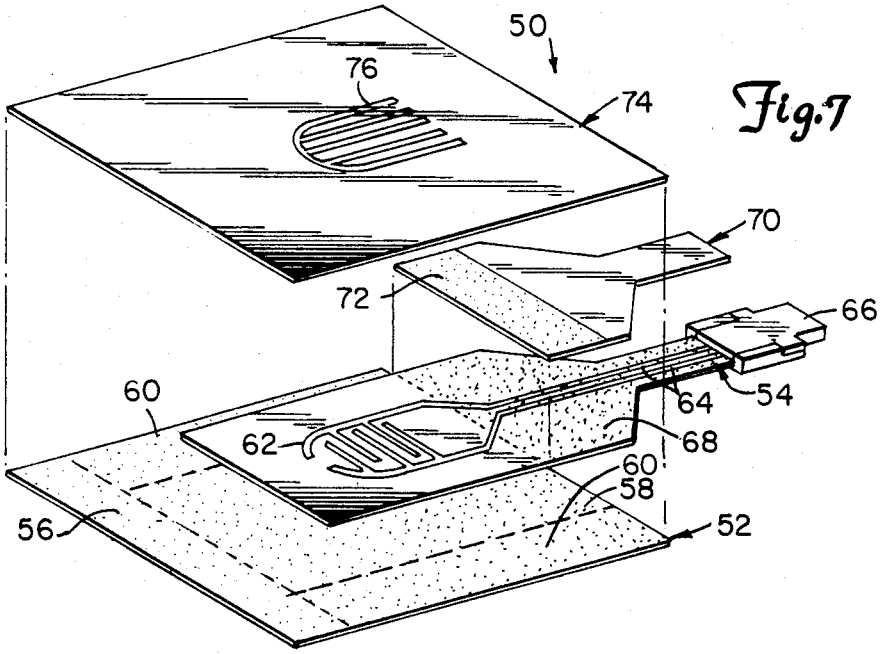
Fig.7

MEMBRANE SWITCH FOR HOPPER

TECHNICAL FIELD

The present invention relates generally to pressure responsive switches, and more particularly to a membrane switch of greater sensitivity and inexpensive construction which is particularly adapted for use in sensing material levels in hoppers.

BACKGROUND

In farming operations, chemicals such as fertilizers, herbicides and insecticides are typically applied by applicator systems mounted on implements towed by tractors over the fields. Such applicator systems generally include at least one hopper for containing a supply of the chemical, and a metering mechanism for metering the chemical into discrete streams in accordance with the desired dosage. Some applicator systems, such as the AIR-SPRED system by Gandy Company, the assignee hereof, also include pneumatic delivery techniques to effect better control during distribution of the chemicals. Such chemicals are relatively expensive, and it will be appreciated that their application is done on an acre by acre basis which is both expensive and time-consuming. Proper operation of the applicator system in turn depends upon various parameters which are preferably monitored on a continuous basis, instead of a periodic basis, so as to avoid waste of the chemical and the need to go over certain areas of the field.

One of the most basic parameters involved in operating such systems is the amount or level of chemical in the hopper. The metering mechanisms of such systems generally include adjustable openings in the bottom end of the hopper along with a feed rotor therein which function best under a certain minimum level of chemical in the hopper. If the amount of chemical drops below a certain level, imprecise metering or distribution, or complete runout of the chemical can occur. Similarly, an undue change or lack of change in the level of chemical in the hopper can signal problems with the metering mechanism or the distribution arrangement of the applicator system. The material in the hopper can be monitored on a manual basis, however, this is impractical. Continuous monitoring of the material level is desirable but is complicated by the bridging characteristics of granular materials.

Devices have been available heretofore for sensing the level of materials in hoppers, however, the devices of the prior art have not been satisfactory for a number of reasons. For example, U.S. Pat. No. 3,396,694 to Gruber and U.S. Pat. No. 2,376,304 to Anderson both relate to bin level indicators having switches or other control devices located behind flexible diaphragms mounted in openings cut into a wall of the bin. These devices are relatively complicated and bulky, and are difficult to install.

Various pressure responsive membrane switches have been developed for use in keyboards and control panels, however, these switches are adapted for localized manual push-button operation and are therefore not suited for sensing a relatively low pressure over a larger area. U.S. Pat. Nos. 4,365,408 to Ditzig; 4,349,712 to Michalski; 4,066,851 to White; and 4,065,649 to Carter are representative of these devices. Heretofore there has not been available an inexpensive membrane switch of greater sensitivity over a more generalized area which is particularly adapted for sensing granular materials in hoppers. Given the increasing emphasis placed upon application of electronics to various monitoring and control functions, together with the continuing need for more proficiency and productivity in farming operations, there is a need for such a switch.

SUMMARY OF INVENTION

The present invention comprises a membrane switch which overcomes the foregoing and other difficulties associated with the prior art. In accordance with the invention, there is provided a pressure responsive membrane switch of greater sensitivity and inexpensive construction which is particularly adapted for use in sensing materials in hoppers, and which is also adapted for convenient location without specialized mounting. In a first embodiment, the membrane switch comprises an elongate first piece of non-conductive material, such as plastic, having on one side thereof conductive material defining an open contact, a pair of leads extending from the open contact to a terminal located at one end, and a cooperating contactor located inward from the other end. A second piece of nonconductive material is secured over the leads, and the first piece is folded back on itself about a transverse fold line such that the contactor is aligned with the open contact, with the other end being secured to the second piece and the edges of the folded portions being secured to seal the contact and contactor within an envelope. The second piece, which functions as a spacer, together with the spring action across the folded end of the first piece, provide sufficient resiliency and sensitivity such that the contact and contactor are normally urged apart but will close under relatively little, less localized pressure. In this embodiment, the switch is normally wedged open by the spring action across the fold, together with the effect of the spacer sheet extending along only one side of the contacts.

In a second embodiment, the membrane switch comprises four pieces of material stacked and secured, instead of two pieces of material with one piece folded over the other as in the first embodiment, to seal the contact and contactor within an envelope. In this embodiment, the switch is normally urged open by the spring action of the top sheet cantilevered over the intermediate sheet and secured to the bottom sheet, together with the effect of the spacer sheet extending along only one side of the contacts. The membrane switches herein, for example, will close under as little as 3 to 4 inches of granular material, which is equivalent to a force of about one ounce, and are therefore especially well suited for sensing material levels in hoppers.

BRIEF DESCRIPTION OF DRAWINGS

A better understanding of the invention can be had by reference to the following Detailed Description in conjunction with the accompanying Drawings, wherein:

FIG. 1 is a partial perspective view (partially cut away for clarity) of a material hopper incorporating the membrane switch of the invention;

FIG. 2 is a top view of a first embodiment of the membrane switch herein;

FIG. 3 is an enlarged cross-sectional view taken along lines 3—3 of FIG. 2 in the direction of the arrows;

FIG. 4 is a perspective, partially exploded, view of the unfolded membrane switch of the first embodiment;

FIG. 5 is a top view of a second embodiment of the membrane switch herein;

FIG. 6 is an enlarged cross sectional view taken along lines 6—6 of FIG. 5 in the direction of the arrows; and FIG. 7 is a perspective, exploded view of the membrane switch of the second embodiment.

DETAILED DESCRIPTION

Referring now to the Drawings, wherein like reference numerals designate like or corresponding elements throughout the views, and particularly referring to FIG. 1, there is shown a hopper 10 incorporating the improved membrane switches 12 of the invention. The hopper 10 comprises an element of a chemical application system (not shown) mounted on an implement for applying granular fertilizer, insecticide, pesticide or other chemical to a field. As shown, the hopper 10 is of the dual bottom type having an inverted central V-shaped portion to permit chemical application over only one-half of the implement for field finishing or when covering areas where chemical is not needed. One membrane switch 12 is located on each side of the central inverted V-shaped portion of hopper 10 for sensing low material levels on either side thereof. It will be understood, of course, that only one membrane switch 12 would be used in single bottom hoppers, or that several switches could be located at different vertical points therein for sensing predetermined material levels.

Although the membrane switches 12 herein is particularly suited for use with hoppers containing dry granular materials, it will be appreciated that the invention could also be adapted for use in sensing liquid levels in tanks.

The membrane switches 12, which of course are mounted inside hopper 10, are connected to a cable connector 14 leading to a multiplexer (not shown) located outside the hopper and an electronic monitor (not shown) located in the cab of the tractor with the operator. The cable connector 14 extends through grommets 16 provided in access holes in the bottom of the hopper 10. The membrane switches 12 are especially adapted for use in the AIR-SPRED electronic monitor system available from Gandy Company, the assignee hereof.

The constructional details of the membrane switch 12 of the first embodiment of the invention are illustrated in FIGS. 2–4. The membrane switch 12 comprises a first elongate sheet 18 and a second relatively shorter sheet 20 which is shaped to cover one end of the first sheet. Sheets 18 and 20 are formed of suitable non-conductive material, such as plastic. Provided on the same side of the first sheet 18 are conductors defining an open contact 22, a pair of leads 24 extending from the open contact to a terminal 26 located at one end of the sheet, and a shunt or contactor 28 located inward from the opposite end of the sheet. The contact 22, leads 24, and contactor 28 can be formed by silk screening with silver ink, or other conventional techniques.

In accordance with the preferred instruction, suitable adhesive is also provided on the same side of the first sheet 18 as the open contacts 22 and contactor 28. Adhesive areas 30 and 32 are located on opposite ends of the sheet 18. The relatively larger adhesive area 30 extends inwardly from the end and adjoins adhesive areas 34 extending along portions of the edges of the first sheet 18. The smaller adhesive area 32 extends between the contactor 28 across the other end of the sheet 18 in spaced relationship with the edgewise adhesive areas 34. The second sheet 20 is secured over the leads 24 by means of adhesive area 30 to prevent shorting of the switch 12.

After the second sheet 20 is secured in place, the first sheet 18 is folded transversely about the fold line 36 to divide the first sheet into portions 18*a* and 18*b*. When folded, the portion 18*a* is secured at its free end to the second sheet 20 by means of adhesive area 32, while at the same time being secured along its edges by adhesive areas 34, such that the contactor 28 is located in closely spaced alignment with the open contact 22, as is best seen in FIG. 3.

The membrane switch 12 is thus of normally open construction. The contact 22 and contactor 28 are urged apart by the spacer effect of the second sheet 20 together with the resiliency of the material and spring effect across the folded end of the first sheet 18. When the membrane switch 12 is subjected to sufficient pressure, the two portions of the first sheet 18 will come together such that the open contact 22 and the contactor 28 will engage thereby closing the switch. This construction provides greater sensitivity and increases the effective contact area such the membrane switch will close under low forces in the neighborhood of as little as an ounce like that generated by three-four inches of granular materials. The membrane switch 12 is preferably sealed about its entire periphery to prevent materials from entering the thin envelope defined between portions 18*a* and 18*b* of the first sheet 18 and thereby interfering with proper operation of the switch.

Although the switch 12 as shown incorporates areas 30, 32, and 34 of contact adhesive, it will be understood that other suitable means can be used for securing the second sheet 20 to one end of the first sheet 18 and securing the end and edges of the folded first sheet to the second sheet. For example, a heated press, ultrasonic means, or a radiant source capable of fusing the materials of sheets 18 and 20 together could be utilized in place of adhesive, and these alternatives are considered the full equivalent thereof.

In accordance with the preferred embodiment, the underside of the lower portion 18*b* of the first sheet 18 includes a layer of contact adhesive 38 thereon which is covered by a peel-away backing 40. See FIG. 3. In order to mount the membrane switch 12, the backing layer 40 is simply peeled away to expose the adhesive 38 so that the switch can be secured to a surface in the desired position without modifications or special mounting requirements.

FIGS. 5–7 illustrate a membrane switch 50 incorporating a second embodiment of the invention. The switch 50 utilizes four sheets of material stacked and arranged instead of two sheets with one folded over the other as in the case of the switch 12 herein, to define an envelope for enclosing the normally open contact and contactor.

In particular, the membrane switch 50 comprises a bottom or first sheet 52 of generally rectangular shape, and a second elongate sheet 54 which is relatively longer and narrower than the first sheet. Sheets 52 and 54 are formed of suitable nonconductive material, such as plastic. The upper side of the first sheet 52 is covered with suitable adhesive to define an adhesive area 56 extending across one end of the sheet, a central adhesive area 58 extending from the first adhesive area 56 to the other end of the first sheet, and adhesive areas 60 extending along portions of the edges of the first sheet. The second plastic or nonconductive sheet 54 is secured to the first sheet 52 by the adhesive area 58. When so secured, the inner end of the second sheet 54 is spaced inwardly from the associated end of the first sheet 52 while the other end of the second sheet extends outwardly beyond the first sheet.

The upper side of the second nonconductive sheet 54 includes conductors thereon defining an open contact 62 and a pair of leads 64 extending from the open contact to a terminal 66 located at the outer end of the sheet. The contact 62 and leads 64 can be formed by silk screening with silver ink, or other conventional techniques. A suitable adhesive is also provided on the upper side of the second sheet 54 to define an adhesive area 68 extending from a point inward from the underlying end of the first sheet 52 to the outer end of the second sheet 54.

A third sheet 70 of nonconductive material, such as plastic, is secured over the leads 64 on the second sheet 54 by means of the adhesive area 68 to prevent shorting of the switch 50. The inner end of the third sheet 70 overlaps a portion of the underlying end of the first sheet 52 to act as a spacer, and covers the projecting end of the second sheet 54. A layer of suitable adhesive is provided across the overlapping portion of the inner end of the third sheet 70 to define an adhesive area 72.

A top or fourth nonconductive sheet 74 of the same shape and size as the first sheet 52 is provided over the first sheet 52, second sheet 54 and third sheet 70. A shunt or contactor 76 is provided on the underside of the fourth sheet 74, and can be formed in similar manner to the contact 62 and leads 64 on the second sheet 54. The fourth sheet 74 is secured along one end and two edges to the first sheet 52 by adhesive areas 56 and 60. The remainder of the other edge of the fourth sheet 74 is secured by adhesive areas 72 to the third sheet 70, which acts as a spacer.

When the sheets 52, 54, 70 and 74 are arranged and secured together as shown, the contactor 76 is located in closely spaced alignment with the open contact 62 inside a thin envelope formed between the sheets. The portions of sheets 54 and 74 on which are located the contact 62 and contactor 76, respectively, are urged apart sufficiently by the spacer sheet 70 and the cantilever effect of the top sheet 74 bridging the intermediate sheet 54 such that the switch 50 is normally open, but closes responsive to low forces in the neighborhood if as little as one ounce like that generated by granular materials 3 to 4 inches deep. In all other respects, the membrane switch 50 functions similarily to the membrane switch 12 herein.

In accordance with the preferred embodiment, the underside of the bottom or first sheet 52 includes a layer of contact adhesive 78 thereon which is covered by a peel away backing 80, as is best seen in FIG. 6, to facilitate mounting the switch 50 in the desired position.

Although the membrane switches 12 and 50 herein have been described with adhesive areas being provided on sides of certain sheets for attachment of adjacent sheets, it will be understood that the adhesive can be provided on the opposing side of the adjacent sheet, if desired. For example, the adhesive area 30 is provided on the upper side of the first sheet 18 of the membrane switch 12, however, it could be provided instead on the underside of the spacer sheet 20. Similarily, the adhesive area 68 is provided on the upper side of the second sheet 54 of the membrane switch 50 herein, however, it could be provided instead on the underside of the third sheet 70. Such would be a mere reversal which is considered fully equivalent to the disclosed structure.

From the foregoing, it will be apparent that the present invention comprises an improved membrane switch having numerous advantages over the prior art. Increased sensitivity over a more generalized area, and simplified, less expensive construction are a few of the important advantages. Lightweight construction and ease of mounting are some more advantages and others will be evident to those skilled in the art.

Although particular embodiments of the invention have been illustrated in the accompanying Drawings and described in the foregoing Detailed Description, it will be understood that the invention is not limited to the embodiments disclosed, but is intended to embrace any alternatives, equivalents, modifications and rearrangements of these elements falling within the scope of the invention as defined by the following claims.

What is claimed is:

1. A membrane switch, which comprises:

a bottom sheet of nonconductive material;

a top sheet of nonconductive material overlying said bottom sheet;

conductive means between said top and bottom sheets defining an open contact, leads extending outwardly from the open contact, and a contactor aligned with the contact;

means for including a spacer sheet extending adjacent to only one side of said conductive means interconnecting said top and bottom sheets in predetermined closely spaced apart relationship to define a narrow envelope therebetween;

the contact and contactor of said conductive means being normally spaced apart in open relationship but responsive to relative positioning of said top and bottom sheets to control the on/off condition of the switch; and a terminal connected to the leads of said conductive means.

2. The membrane switch of claim 1, wherein said top and bottom sheets are formed of plastic.

3. The membrane switch of claim 1, wherein said top and bottom sheets are integrally formed from a single piece of nonconductive material folded transversely, and wherein the spacer sheet of said interconnecting means overlies the leads of said conductive means and is adhesively secured between opposite adjacent ends of said sheet of transversely folded nonconductive material.

4. The membrane switch of claim 1, wherein said interconnecting means comprises:

an intermediate sheet having an inner portion extending between said top and bottom sheets, and an outer portion;

the open contact and leads of said conductive means being formed on said intermediate sheet;

the spacer sheet being of nonconductive material having an inner portion adhesively secured between said top sheet and part of the inner portion of said intermediate sheet, and an outer portion adhesively secured to the outer portion of said intermediate sheet; and the contactor of said conductive means being formed on the inside of said top sheet.

5. The membrane switch of claim 1 further including:

a layer of adhesive on the underside of said bottom sheet; and a peel-away backing on said adhesive layer.

6. A membrane switch of improved, generalized sensitivity, comprising:

an elongated first sheet of non-conductive, resilient material;

conductive means on one side of said first sheet defining an open contact, leads extending from the open contact toward one end of said first sheet, and a contactor located between the contact and the other end of said first sheet;

a second sheet of non-conductive material overlying the leads and terminating adjacent one side of the open contact of said conductive means on said first sheet;

the other end of said first sheet being folded back and secured to said second sheet such that the open contact and the contactor of said conductive means are aligned in close spaced-apart relationship;

the adjacent edges of said folded first sheet being secured together substantially entirely between the fold and second sheet to define narrow envelope enclosing the contact and contactor; and a terminal connected to the leads of said conductive means.

7. The membrane switch of claim 6, wherein said first and second sheets are formed of plastic.

8. The membrane switch of claim 6, wherein said second sheet is adhesively secured to said first sheet, and wherein the edges of said folded first sheet are adhesively secured.

9. The membrane switch of claim 6, further including:

a layer of adhesive on the side of said first sheet opposite the side bearing said conductive means; and a peel-away backing on said adhesive layer.

10. A membrane switch of improved, generalized sensitivity, comprising:

a first sheet of nonconductive material;

an elongate second sheet of nonconductive material, said second sheet having inner and outer end portions with the inner end portion overlying the first sheet;

first conductive means on the side of said second sheet opposite the first sheet defining an open contact on the inner end portion of the second sheet and leads extending from the open contact on the outer end portion of the second sheet and terminating adjacent one side of the open contact of said first conductive means;

a third sheet of nonconductive material having an outer end portion overlying the outer end portion of said second sheet, and an inner end portion overlying part of the inner end portion of said second sheet;

a fourth sheet of nonconductive material overlying said first sheet and the inner end portions of said second and third sheets;

second conductive means on the side of said fourth sheet facing said second sheet to define a contactor in aligned, closely spaced apart relationship with the contact on said second sheet;

the adjacent edges of said first and fourth sheets and inner end portion of said third sheet being secured together to define a narrow envelope enclosing the contact and contactor; and a terminal connected to the leads of said first conductive means.

11. The membrane switch of claim 10, wherein said first, second, third and fourth nonconductive sheets are formed of plastic.

12. The membrane switch of claim 10, wherein the inner end portion of said second sheet is adhesively secured to said first sheet.

13. The membrane switch of claim 10, wherein the outer end portions of said second and third sheets are adhesively secured.

14. The membrane switch of claim 10, further including: a layer of adhesive on the side of said first sheet opposite said second sheet; and a peel-away backing on said adhesive layer.

15. A membrane switch, which comprises:

a bottom sheet of non-conductive material;

an intermediate sheet of non-conductive material partially overlying and adhered to said to said bottom sheet;

a spacer sheet of non-conductive material partially overlying said intermediate sheet;

a top sheet of non-conductive material overlying said bottom sheet;

means for connecting said top, intermediate, spacer, and bottom sheets in predetermined stacked relationship to define a narrow envelope between said top sheet and said intermediate sheet;

said top and intermediate sheets are forced apart by position of said spacer sheet between said top sheet and one end of said intermediate sheet and the cantilever spring action of said top sheet resting on the edges of said intermediate sheet while connected to said bottom sheet;

conductive means between said top and intermediate sheets defining and open contact, leads extending outwardly from the open contact, and a contactor aligned with the contact;

the contact and contactor of said conductive means being normally spaced apart in open relationship inside said narrow envelope but responsive to relative positioning of said top and intermediate sheets to control the open/closed condition of the switch; and a terminal connected to the leads of said conductive means.

* * * * *